United States Patent [19]

Durocher

[11] Patent Number: 4,997,082

[45] Date of Patent: Mar. 5, 1991

[54] HUMIDISTAT

[75] Inventor: Donald F. Durocher, Roswell, Ga.

[73] Assignee: Kimberly-Clark Corporation, Neenah, Wis.

[21] Appl. No.: 351,240

[22] Filed: May 16, 1989

Related U.S. Application Data

[63] Continuation-in-part of Ser. No. 212,639, Jun. 28, 1988, abandoned.

[51] Int. Cl.[5] ..... B65D 85/10; B65D 81/24

[52] U.S. Cl. ..... 206/204; 206/205; 206/242

[58] Field of Search ..... 206/204, 205, 242; 239/55, 56

[56] References Cited

U.S. PATENT DOCUMENTS

| | | | |
|---|---|---|---|
| 274,425 | 3/1883 | Wells | 239/55 |
| 881,790 | 3/1908 | Gates | 239/55 |
| 911,331 | 2/1909 | Rose | 239/55 |
| 1,540,484 | 7/1925 | Larsen | 239/55 |
| 1,700,574 | 1/1929 | Smith | 239/55 |
| 1,871,419 | 8/1932 | McKee . | |
| 2,329,908 | 9/1943 | Johnson | 206/205 |
| 2,333,270 | 11/1943 | Opler | 206/205 |
| 2,365,185 | 12/1944 | Gailey | 299/24 |
| 2,452,957 | 11/1948 | Sabin | 299/24 |
| 2,529,578 | 11/1950 | Thompson | 239/55 |
| 2,767,018 | 10/1956 | McDonald | 299/20 |
| 3,276,944 | 10/1966 | Levy | 156/308.6 |
| 3,338,992 | 8/1967 | Kinney | 264/109 |
| 3,341,394 | 9/1967 | Kinney | 264/123 |
| 3,452,615 | 7/1969 | Gregory, Jr. | 74/502.3 |
| 3,471,305 | 10/1969 | Marbach | 206/205 |
| 3,502,763 | 3/1970 | Hartmann | 264/103 |
| 3,567,118 | 3/1971 | Shepherd et al. | 239/6 |
| 3,623,659 | 11/1971 | Maierson et al. | 239/56 |
| 3,692,618 | 9/1972 | Dorschner et al. | 156/167 |
| 3,801,011 | 4/1974 | Guehler et al. | 239/34 |
| 3,815,828 | 6/1974 | Engel | 239/56 |
| 3,855,046 | 12/1974 | Hansen et al. | 156/290 |
| 3,881,490 | 5/1975 | Whitehead et al. | 128/287 |
| 4,055,672 | 10/1977 | Hirsch et al. | 426/127 |
| 4,094,119 | 6/1978 | Sullivan | 53/4 |
| 4,100,324 | 7/1978 | Anderson et al. | 156/167 |
| 4,145,001 | 3/1979 | Weyenberg et al. | 239/56 |
| 4,158,440 | 6/1979 | Sullivan et al. | 239/1 |
| 4,162,863 | 7/1979 | Gaudard et al. | 405/45 |
| 4,192,420 | 3/1980 | Worrell Sr. et al. | 206/205 |
| 4,340,563 | 7/1982 | Appel et al. | 264/210.8 |
| 4,356,969 | 11/1982 | Obermayer | 239/6 |
| 4,529,125 | 7/1985 | Sullivan | 239/56 |

FOREIGN PATENT DOCUMENTS

| | | | |
|---|---|---|---|
| 478793 | 1/1938 | United Kingdom | 206/204 |
| 1369992 | 10/1974 | United Kingdom | 206/204 |
| 2158356 | 11/1985 | United Kingdom | 239/56 |

*Primary Examiner*—Steven N. Meyers
*Assistant Examiner*—Jacob K. Ackun, Jr.
*Attorney, Agent, or Firm*—William D. Herrick

[57] ABSTRACT

There is disclosed a package with controlled humidity for storing products such as tobacco and food. The package is an enclosed container with a humidistat pad inside which pad serves as a spacer and holds a humectant solution in its liquid phase in an absorbent interior layer. The pad has a liquid impervious backing layer to protect the walls of the container from the liquid humectant solution. The pad also has a liquid permeable cover which can rapidly transfer the humectant solution deposited on it to the absorbent layer during filling of the container with the product.

10 Claims, 3 Drawing Sheets

HUMIDISTAT

This application is a continuation-in-part of copending U.S. patent application Ser. No. 07/212,639, filed June 28, 1988, now abandoned.

BACKGROUND OF THE INVENTION

This invention relates generally to humidistats for maintaining relative humidity in a package and more particularly concerns a humidistat pad which serves both as a spacer in a package and as a humidistat.

A number of perishable commodities including food products and tobacco products, for example, retain their optimum freshness and desirability when stored in environments in which a predetermined relative humidity is maintained. Normally, in the case of food and tobacco products, it is desirable to maintain a relative humidity in the package which is higher than the ambient relative humidity. It may also be desirable, however, to maintain a relative humidity in the package which is less than the ambient relative humidity when the same food and tobacco products are stored in damp environments.

In general, the relative humidity in an enclosed, generally air tight package is maintained by providing a humectant, generally a water based solution, within the package in its liquid phase. The humectant solution vaporizes in the package producing water vapor in the package. When the partial pressure of water vapor in the package is equal to the vapor pressure of water for the humectant solution, an equilibrium is reached where the humectant gives off water vapor at the same rate as water vapor condenses back into the humectant liquid. Depending on the equilibrium vapor pressure of the water over the humectant solution selected, a predetermined relative humidity may be established in the enclosed package.

As recognized in the prior art, one important aspect of any liquid humidistat used in a package is confinement of the liquid phase so that the liquid does not come into direct contact with either the package or with the product packaged therein via wicking, gravity, etc.

Sabin U.S. Pat. No. 2,452,957 discloses a moisture control device for humidifying a conventional package of cigarettes. The humidistat includes a rectangular envelope made of uncoated regenerated cellulose or coated regenerated cellulose. Such materials are substantially waterproof, i.e. impermeable to liquid, but capable of transmitting vapor. Two grams of moistened Glauber's salt (sodium sulfate decahydrate) are sealed in the envelope to provide a source of water vapor while retaining the liquid solution from contacting either the package or the cigarettes.

Gailey U.S. Pat. No. 2,365,185 discloses a tobacco humidifying device. A textured sponge rubber sponge is saturated with water and attached to the lid of a tobacco canister. The sponge is covered with a sheet of moisture proof material which is metal or wax paper to prevent the tobacco within the canister from making direct contact with the moist sponge.

Guehler et al. U.S. Pat. No. 3,801,011 discloses a humidity control device for packages. The humidistat consists of a sheet-like material with a partially exposed layer of water containing micro-capsules adhered to it. The capsules have vapor transmitting walls which allow the water contained therein to vaporize and pass into the package.

McDonald U.S. Pat. No. 2,767,018 discloses a humidistat comprising a glass tube with an absorbent plug such as cotton at its open end. Water is contained in the tube and slowly volatilizes through the cotton plug to provide humidity to the surrounding enclosed environment.

McKee U.S. Pat. No. 1,871,419 discloses a humidifying sheet material for cigars. The sheet material carries humidifying agents in a dry condition which sheet material may be placed in direct contact with the cigars. The humidifying agent is moistened Glauber's salt, and the sheet material is tissue paper or fine mesh cloth.

The prior art also teaches various devices for dispensing volatile substances such as air fresheners and the like into an open (as compared to enclosed) environment.

Sullivan U.S. Pat. No. 4,529,125 discloses a device for dispensing volatile substances such as air fresheners and the like. Particularly, the device includes a pad having a reservoir layer for holding the volatile substance in its liquid phase and envelope layers on each side of the reservoir layer. The envelope layers are permeable to the volatile substance to allow for diffusion of the vapor through the envelope layers. The dispensing device is particularly designed to insure that the liquid phase of the volatile substance does not leak or come in contact with the environment and that the pad only dispenses the product in its vapor form. The volatile substance is incorporated directly into the reservoir layer while the dispensing device is being made, and the entire dispensing device is sealed into an air tight container so that the volatile substance does not volatilize and escape prior to being sold or used by the ultimate consumer.

Obermayer et al. U.S. Pat. No. 4,356,969 likewise discloses a vapor dispenser comprising a reservoir to contain a non-flowing liquid. The outer cover about the reservoir includes a membrane for vapor emission which emits the vapor at some predetermined rate. The reservoir itself is a gel-like material composed essentially of a liquid gel form which contains a volatile fragrance to be dispensed.

Sullivan et al. U.S. Pat. No. 4,158,440 discloses a device for releasing a volatile substance which includes a reservoir for storing the substance. The reservoir is surrounded by permeable material which has greater affinity for the volatile substance than the reservoir material has. An impermeable film is wrapped around the permeable material and sealed in order to retain the volatile substance in the reservoir until the dispensing device is opened for use. The reservoir may be filled at any time prior to the final sealing of the impermeable envelope. If the dispensing device is filled after manufacture, the reservoir material must be first impregnated with an expendable substantially nonvolatile substitute substance to prevent collapse of the reservoir material. The substitute substance is soluble in the volatile substance which will be added later in its place.

Sullivan U.S. Pat. No. 4,094,119 discloses a dispenser for a volatile substance including a reservoir and a permeable envelope. The volatile substance is supplied to the reservoir material prior to the reservoir material being encapsulated in the permeable envelope. Once the pad has been formed, the entire pad is sealed for distribution prior to use.

Engel U.S. Pat. No. 3,815,828 discloses a dispenser for dispensing volatile substances as a vapor. The dispenser includes a pad impregnated with an aqueous emulsion of the volatile substance. The pad is sealed in a liquid impervious but vapor permeable envelope. The pad is impregnated with the substance by immersing it in a bath of the aqueous emulsion.

O'Brien, *J. Sci. Instruments*, pp. 73–76 (March 1948) lists metal salts and equilibrium R.H. ranges. Additional listings will be known to those skilled in the art, such as *CRC Handbook of Chemistry and Physics*, 68th ed. (1987).

While the prior art discloses any number of ways for retaining a liquid substance in a reservoir for volatilization into the environment, none of the prior art patents addresses the problem presented by providing a humidistat in a package where the humidistat pad also functions as a spacer and where the humectant solution is added to the humidistat pad during the filling of the package on a high-speed production line.

SUMMARY OF THE INVENTION

It is therefore an object of the present invention to provide an enclosed package with controlled humidity which package includes a humidistat pad for holding a humectant solution in its liquid phase while protecting the package and its contents from contact with the liquid phase of the humectant solution.

It is also an object of the present invention to provide a package with controlled humidity having a humidistat pad which serves as a spacer in the package.

It is likewise an object of the present invention to provide a humidistat pad which is rigid when saturated with the humectant solution.

It is likewise an object of the present invention to provide a humidistat pad which maintains its loft and resiliency when wet with the humectant solution.

It is further an object of the present invention to provide a method for rapidly charging the humidistat pad with the humectant solution during production of the package.

The foregoing objectives are achieved by a package consisting of an enclosed container with walls which may deteriorate when subjected to water in its liquid phase. The package includes a humidistat pad consisting of a liquid impervious backing layer, an absorbent layer, and a liquid permeable cover. A humectant solution consisting of a saturated salt solution is retained in the absorbent layer of the humidistat pad, and water vapor is released through the permeable cover. The impervious backing layer is disposed between the absorbent layer and the wall of the enclosed container to protect the wall from the liquid phase of the humectant solution. The humidistat pad may be embossed to enhance the rigidity and integrity of the pad. The absorbent layer is a coform sheet of wood pulp fibers and polymer fibers which has sufficient loft and resilience to serve as a spacer within the closed container even when wet with the humectant solution.

In order to realize the full benefit of the invention, it is desirable to charge the humidistat pad with a humectant solution just prior to the insertion of the humidistat pad into the enclosed container. Therefore, where high speed production and packaging machinery is being used, it is important that the humidistat pad imbibe the humectant solution rapidly. The permeable cover in one embodiment is a spun-bonded web which has been treated with a surfactant to facilitate the transfer of the humectant solution from the cover to the underlying absorbent layer. The speed of imbibing can be further enhanced by heating the humectant solution prior to deposit on the cover of the humidistat pad or by prewetting the cover of the humidistat pad prior to deposit of the humectant solution on the cover.

Other objects and advantages of the invention will become apparent upon reading the following detailed description and upon reference to the drawings.

DETAILED DESCRIPTION OF THE INVENTION

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
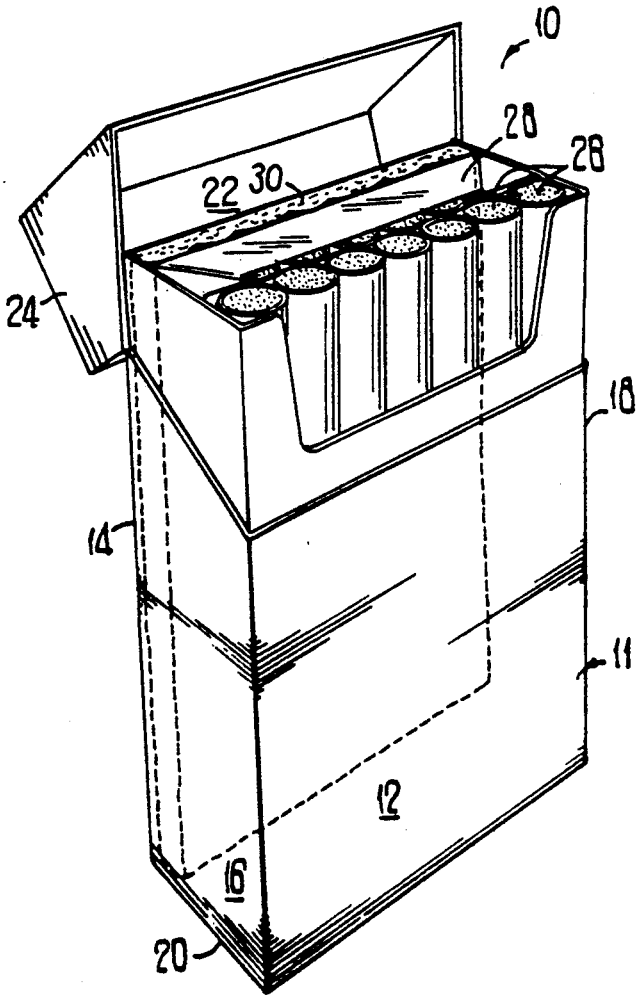
FIG. 1 is a perspective view of a package embodying the present invention.

Turning to FIG. 1, there is shown a package 10 embodying the present invention. Particularly, the package 10 is an enclosed cigarette box 11. It should be understood that the invention has application to any enclosed container which is used to store any product and in which a particular relative humidity should be maintained. The package 10 is in general a conventional cigarette box 11 formed of paper board. Such paper board may deteriorate if exposed to water in its liquid phase. The cigarette box 11 has a paper board front wall 12, a back wall 14, side walls 16 and 18, a bottom 20, and a top 22. The box 11 has a conventional =flip top" 24 which is shown in the open position but is obviously closed after the box 11 is initially filled with 20 cigarettes 26. The cigarettes 26 are wrapped in foil 28, and the entire box is sealed in an outer transparent wrap (not shown) after packaging and during the time the box is maintained in inventory for sale.

During the time the box 11 is held in inventory for sale, it is desired that the relative humidity inside the enclosed box 11 be maintained at a relative humidity of about 60% to 65%. Likewise, it is desired that the cigarettes be held snugly together so that during shipment they do not become damaged by physical vibration or shock.

In order to provide the desired relative humidity in the enclosed box 11 and to hold the cigarettes, a humidistat pad 30, which is co-extensive with the back wall 14, is inserted inside the box 11. The humidistat pad is of sufficient thickness and resilience to act as a spacer and cushion to force the cigarettes toward the front of the box and thereby maintain them snugly together.

Figure 2:
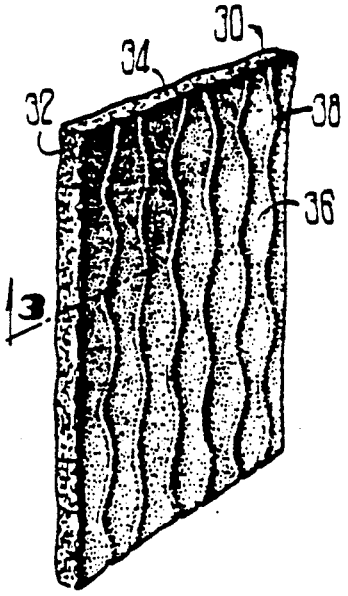
FIG. 2 is a perspective view of a humidistat pad of the present invention.
Figure 3:
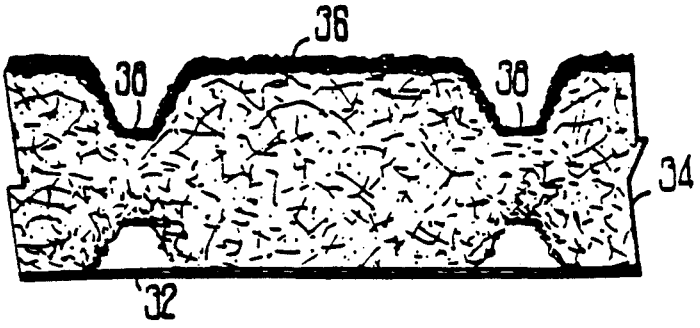
FIG. 3 is a cross-section view of the humidistat pad as seen along line 3—3 of FIG. 2.

As can be seen in FIGS. 2 and 3, the humidistat pad 30 is generally rectangular in shape and consists of a liquid impervious backing layer 32, an absorbent layer 34, and a liquid permeable cover 36. The pad in addition may be embossed. The emboss lines 38, which may be arranged in a decorative pattern, impart rigidity to the pad and bind the layers together to prevent delamination.

The humidistat pad 30 is impregnated or charged with a humectant solution which is retained inside the absorbent layer 34 in its liquid phase. The selected humectant solution has a vapor pressure which establishes the desired relative humidity within the enclosed box 11. Any known listing of suitable humectants such as O'Brien, *J. Sci. Instruments*, pp. 73–76 (March 1948) may be consulted to select a desired humectant based on factors such a compatibility, cost, etc. The humectant solution migrates from absorbent layer 34 to the cover 36 where it evaporates and gives off water vapor into the enclosed box 11. When the partial pressure of water in the enclosed box 11 equals the vapor pressure for the particular humectant solution used, equilibrium is reached. In a state of equilibrium, the humectant solution gives off or condenses water vapor at the same rate as the water vapor in the enclosed box 11 escapes or enters through the walls of the box. In connection with cigarettes, the optimum relative humidity in the box is between about 60% and 65%. Suitable humectant solutions for cigarettes include the following:

| Humectant Solution | Percent Relative[2] Humidity | Temperature[2] (°C.) | Concentration (g/ml of $H_2O$) |
|---|---|---|---|
| Potassium Carbonate ($K_2CO_3.2H_2O$) | 43 | 24.5 | 1.47 @ 20° C.[2] |
| Magnesium Acetate ($Mg(C_2H_3O_2)_2.4H_2O$) | 65 | 20 | 1.20 @ 20° C.[2] |
| Sodium Acetate ($NaC_2H_3O_2.3H_2O$) | 76 | 20 | 1.19 @ 20° C.[2] |
| Ammonium Nitrate $NH_4Cl$ | 68.6 | 30 | 0.28 @ 0° C.[1] |
| Ammonium Nitrate $NH_4NO_3$ | 65[3] | 20[3] | 1.18 @ 0° C.[2] |
| Sodium Bromide $NaBr^{\circ}2H_2O$ | 58 | 20 | 1.16 @ 50° C.[2] |

[1]The Merck Index, tenth edition, Martha Windholz, Editor, Merck & Co., Inc. Rahway, N.J., 1983
[2]CRC Handbook of Chemistry and Physics, 68th Edition, Robert Weast, Editor, CRC Press, Inc., Boca Raton, Florida, 1987, E-42
[3]Specification for Laboratory Humidity Ovens (non-injection type), B.S. 3718:1964, British Standards Institution, British Standards House, 2 Park Street, London, W.1

EXAMPLES 1–2

A saturated solution of magnesium acetate [$Mg(C_2H_3O_2)_2.4H_2O$]was prepared by mixing and heating to 70° C., 200 g of magnesium acetate in 100 ml of water in a 500 ml flask. The saturated salt solution was cooled to room temperature and placed in a well sealed bottle.

A saturated solution of potassium carbonate [$K_2CO_3.4H_2O$]was prepared by mixing and heating to 70° C., 300 g of potassium carbonate in 100 ml of water in a 500 ml flask. The saturated salt solution was cooled to room temperature and placed in a well sealed bottle.

Two, 2"×2" pads were cut from a 250 g/m$^2$ co-formed pad, produced in accordance with U.S. Pat. No. 4,100,324 and containing 70/30 mixture of wood pulp to polypropylene fibers, having a lined emboss pattern, a polyethylene back cover, and spunbond top cover. One milliliter of saturated salt solution was allowed to soak into each pad and the pad placed in a 250 ml flask and tightly sealed. Several hours were allowed for the humidistat to achieve equilibrium in the flask.

The humidity in each flask was measured using a dc Instant Rh meter made by the Dickson Company, Addison, IL, 60101. The sensing element of this device was placed in the neck of the flask and any holes were taped shut. The system was again allowed to equilibrate for several hours. As shown in the Table below, the relative humidity established by the humidistat is nearly indistinguishable from that above a saturated salt solution.

| Humectant Saturated Solution | Temperature °C. | Rh Above a Saturated Salt Solution | RH Above a Humidistat Pad |
|---|---|---|---|
| Potassium Carbonate | 22 | 45% | 47% |
| Magnesium Acetate | 22 | 65% | 65% |

Ideally a two phase salt system consisting, for example, of an aqueous phase of saturated magnesium acetate and a solid phase of magnesium acetate would fix the relative humidity above the mixture at the thermodynamically fixed value. However, this type of mixture would be quite difficult to apply to the absorbent pad substrate. In practice, it is only necessary to apply a saturated salt solution to the pad to achieve nearly the same results.

Use of a saturated salt solution differs from the normal use of a humectant in that the solution not only provides a reservoir of moisture, but also maintains the relative humidity at a fixed level despite large fluctuations in moisture transmission through the package. To simplify preparation, the humectant solution need not be a saturated salt solution, but may only be near to saturation, for example, 90% of saturation. If conditions of storage of the box are such that the ambient humidity is lower than that for the saturated solution, the salt solution will lose water until the solution is saturated. Immediately upon achieving saturation, the relative humidity within the box will be maintained at that level dictated by the salt solution (see Table) until all the moisture is removed from the saturated salt solution. If the ambient humidity surrounding the box is greater than that of the saturated solution, water will be condensed into the nearly saturated salt solution and the humidity maintained within the package will be near that of the saturated solution. In both cases, the salt solution will act as a buffer to protect the product from swings in ambient humidity and, more importantly, from losing a large complement of its moisture.

The impervious backing layer 32 is a thin film such as polyethylene which is adhesively attached to the absorbent layer 34. A one mil polyethylene film is generally preferred. Alternatively, a meltblown backing could be applied which, while porous to air, is impervious to humectant solution migration under normal pressures. The backing layer 32 is disposed in the box 11 between the absorbent layer 34 and the back wall 14 of the paper board box so that the humectant solution in its liquid phase cannot come in direct contact with the paper board and cause it to deteriorate.

The absorbent layer 34 consists of intermingled discrete fibers which are capable of absorbing and retaining the humectant solution in its liquid phase. The absorbent layer 34 must also possess a degree of rigidity and resilience even when wet with the humectant solution. The absorbent layer 34 may be any number of absorbent materials such as compressed fluff pulp, laminated tissue or coform absorbent. The absorbent layer 34 is bonded to the film by adhesive, sonic bonding, or other suitable methods. A coform sheet is preferred for the absorbent layer 34. The production of the coform layer 34 is in accordance with the disclosure in Anderson et al. U.S. Pat. No. 4,100,324. The coform layer 34 may include combinations of natural and man-made fibers. The meltblown fibers of the coform layer may be made from polypropylene, polyethylene, polyester, or nylon. Generally polypropylene is preferred. The staple length fibers of the coform layer may be cellulose, cotton, flax, jute, silk, polypropylene, polyethylene, polyester, rayon, or nylon. Because of its cost, cellulose is preferred in connection with the absorbent layer 34 for the staple length fibers. Particularly, the coform layer is preferably a 70/30 mixture of wood pulp (staple length) to polymer (short) fibers. When the coform layer 34 comprises this mixture of fibers, the quantity of absorbent material in the coform layer is 10–20% of the weight of the humectant solution that the humidistat pad is intended to absorb and hold. In connection with the humidistat pad of the present invention, the absorbent layer 34 has a basis weight from 300–400 grams per square meter ($g/m^2$) which assures adequate capacity, rigidity, and resilience when wet.

The liquid permeable cover 36 is a web which must be permeable to the humectant solution so that the cover can transfer the humectant solution to the absorbent layer 34 when the humidistat pad is being charged with the humectant solution. The cover 36 must also provide sites for vaporization of the humectant solution into the surrounding enclosed box 11. The liquid permeable cover may be a nonporous polymer film perforated to allow entry and exit of humectant solution and water vapor respectively. Similarly, a tissue sheet made from wood pulp could be used for the cover. A spunbonded web of polypropylene filaments with a basis weight of about 10 $g/m^2$, however, is preferred.

The nonwoven spunbonded web for cover 36 is prepared in conventional fashion such as illustrated by the following patents: Dorschner et al. U.S. Pat. No. 3,692,618; Kinney U.S. Pat. Nos. 3,338,992 and 3,341,394; Levy U.S. Pat. No. 3,276,944; Hartmann U.S. Pat. Nos. 3,502,763 and 3,909,009; Dobo, et al. U.S. Pat. No. 3,542,615; Appel et al. U.S. Pat. No. 4,340,563; Hansel et al. U.S. Pat. No. 3,855,046; and Harmon Canadian Patent No. 803,714. Spunbonded materials prepared with continuous filaments generally have at least three common features. First, the polymer is continuously extruded through a spinneret to form discrete filaments. Thereafter, the filaments are drawn either mechanically or pneumatically without breaking in order to molecularly orient polymer filaments and achieve tenacity. Last, the continuous filaments are deposited in a substantially random manner to form the web.

The humidistat pad 30 may be embossed with any decorative embossing pattern such as emboss lines 38. The emboss lines 38 add rigidity to the pad and enhance the bonding between the layers of the humidistat pad. The resulting pad has a rigidity of at least 9 cm as tested in accordance with the test method described by Method 5206, Federal Test Methods Standard No. 191A using FRL TM Cantilever Bending Tester, Model 79–10 available from Testing Machines Incorporated, Amityville, N.Y. The test method employs a sample size of 1 inch by 8 inches and a platform angle of 41.5°. The results are expressed as Drape Stiffness, which is defined as one-half the bending length required to achieve an angle of 41.5°. In addition, because of its coform layer 34, the pad maintains resiliency to pressure exerted on the pad (vertical in FIG. 3) so that the pad 30 serves as a spacer and cushion even when wet with the humectant solution. The resilience of the pad is at least 75% when measured using a Standard Model Compressometer available from Frazier Precision Instrument Company, 210 Oakmont Avenue, Gaithersburg, Md. In this test, a circular foot, one inch in diameter forces the pad down with a pressure expressed in pounds per square inch (psi). The bulk of the material is measured while the pad is under compression. Resilience is defined as the percent retention of bulk when the pressure on the foot is changed from 0.1 psi to 3.0 psi. For example, if the initial bulk was 0.20 inches and the final bulk 0.16 inches, the resiliency would be $(1-(0.20-0.16)/0.20)\times 100=80\%$.

It is important that the humidistat pad 30, which also serves as a spacer in an enclosed container, such as the cigarette package shown in FIG. 1, can be inserted into the box 11 along with a cigarette on high speed production equipment. It is desirable that the humectant solution be added to the humidistat pad just prior to this operation so that the pads may be stored in dry form. This will insure pad integrity and freedom from humectant solution loss. In addition, the pad 30 should be provided in a continuous roll and cut to size during the package filling operation. Because of the requirements of high speed automated package filling, it is necessary that the humectant solution be added to the pad at the time the box 11 is filled. Consequently, it is necessary that the charging step in the process be accomplished quickly. Specifically, in connection with packaging cigarettes, it is necessary that one ml of the humectant solution be absorbed through the cover and into the pad in one second or less with no leaking of the humectant solution during such packaging.

In order to assure rapid charging of the humidistat pad with the humectant solution, several methods may be employed. First, the spunbonded polypropylene cover material can be treated with a surfactant which will hasten the transport. Particularly preferred is Triton X 102 which is an octylphenoxypolyethoxyethanol nonionic surfactant, manufactured by Rohm and Haas Company. In addition, the humectant solution which is highly concentrated and therefore viscous can be heated in order to lower its viscosity and thereby increase the speed of its absorption into the humidistat pad. Another strategy for increasing the speed of charging is to pre-wet the liquid permeable cover with a water spray prior to depositing the humectant solution onto the cover.

Particularly, addition of Triton X 102 in an amount of 3% by weight of the cover has been found effective in increasing the absorption rate of a magnesium acetate solution (1.20 g salt/ml$H_2O$) to values in excess of 1 ml/sec. Likewise, the rate of absorption can be enhanced by heating the same humectant solution above room temperature prior to depositing it on the cover of the pad. Speed of absorption is also increased by spraying 4 g of water per square meter of pad cover surface onto the pad cover prior to depositing the humectant solution on the cover.

To demonstrate these effects, two by two inch pads were cut from 250 $g/m^2$ co-form material having a plastic liner and spunbond top cover. It took approximately two seconds for 0.8 ml of a saturated solution of magnesium acetate to be imbibed.

The solution was heated to approximately 50° C. and the solution was imbibed into the pad much faster ($<\sim 1$ second).

The pad cover was pre-moistened with 0.08 ml of water per pad and the absorption of humectant was again hastened to $<1$ second.

The pad was cover treated to contain 3% by weight of the pad cover with Triton X102 and dried. Absorption of the humectant was hastened to $<\sim 1$ second.

Figure 4:
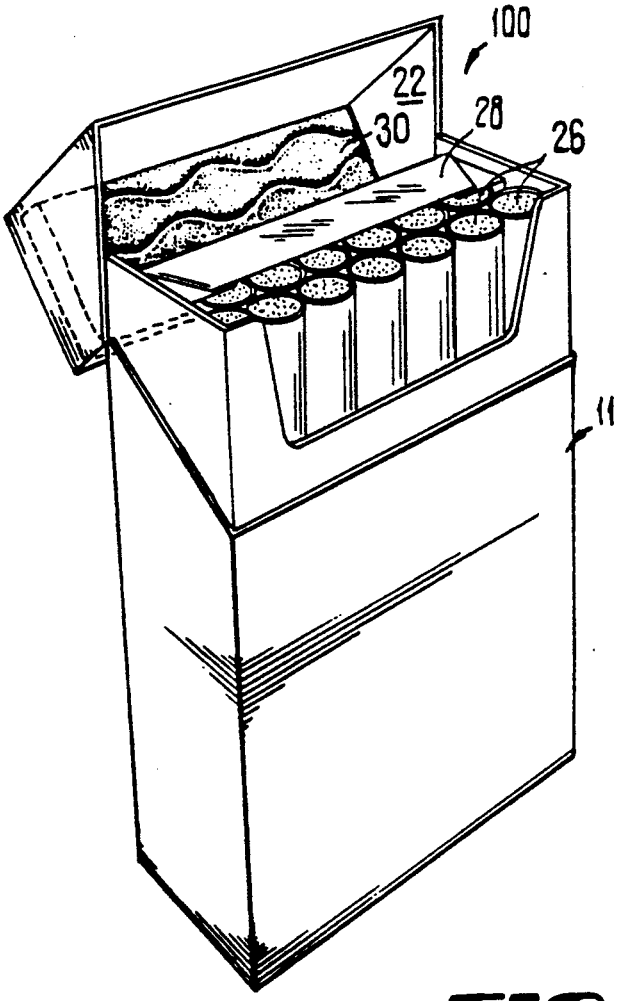
FIG. 4 is a perspective view of another package embodying the present invention.
Figure 5:
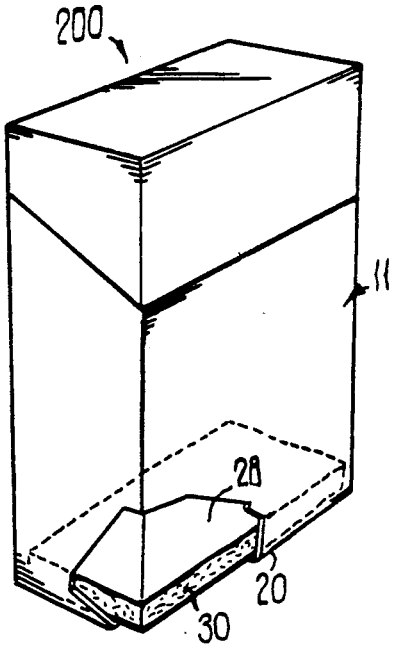
FIG. 5 is a perspective view of yet another package embodying the present invention.

Turning to FIG. 4, there is shown an alternative embodiment of the invention which shows package 100, which comprises the enclosed cigarette box 11 with the humidistat pad 30 disposed in the top of the box 11 above the cigarettes. Another embodiment of the invention is shown in FIG. 5. Here package 200 comprises humidistat pad 30 disposed in the bottom of the box 11. In both alternative embodiments the liquid impervious backing layer is adjacent the top 22 and bottom 12 respectively of the box 11.

Figure 6:
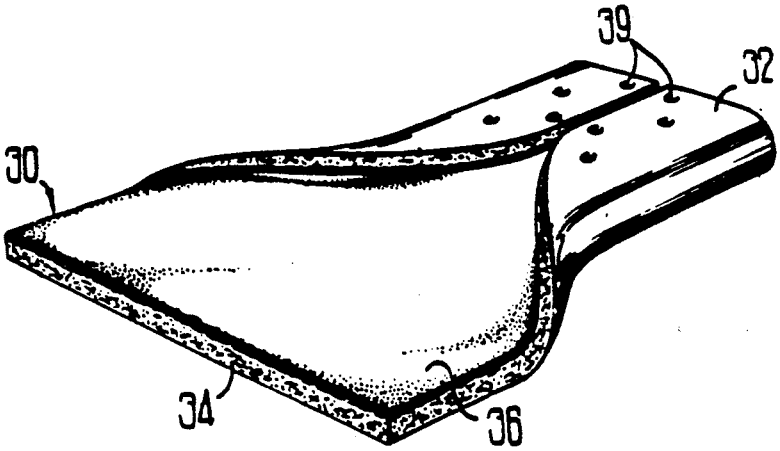
FIG. 6 is a perspective view of a humidistat pad in an alternative embodiment of the present invention.
Figure 7:
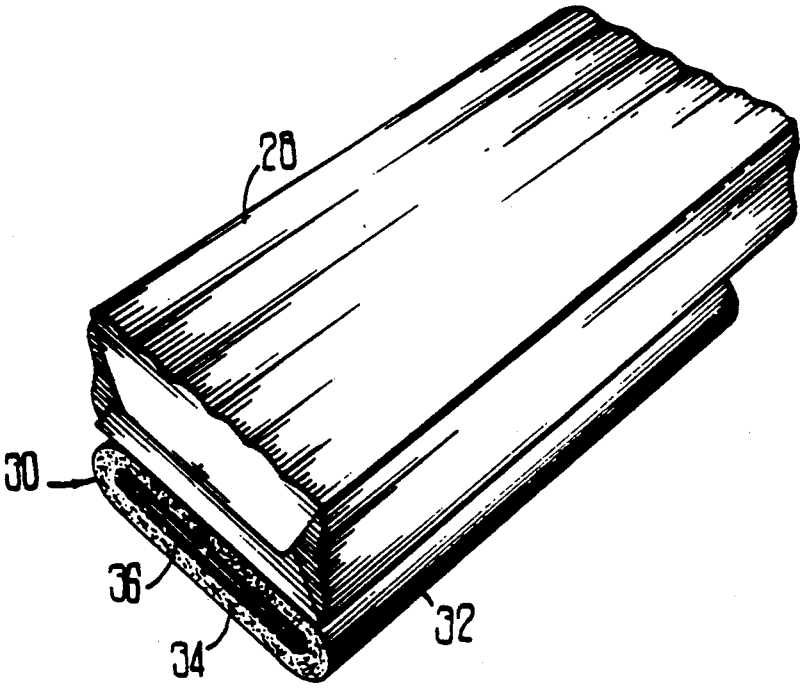
FIG. 7 is a perspective view of an alternative embodiment of the present invention.

Turning to FIG. 6, there is shown an additional alternative embodiment of the present invention which shows a coform pad 30 which is approximately twice as wide as the box 11. The pad 30 is folded over on itself in a "C" fold after being treated with the salt solution. The folded pad 30 is held shut by bonding with an embossed pattern of points 39 or lines or by gluing or otherwise bonding the surfaces shut. The ends of the "C" folded pad 30 may also be sealed by thermal means or application of an adhesive. The pad 30 is then inserted into the box 11, such that the open portion is in contact only with the foil (see FIG. 7). The polyethylene cover 32 protects the box board from contacting the humectant solution, while the open slit area or the open ends allow water vapor to be transmitted to the package. The coform would be in the weight range of 150 to 250 g/m$^2$. The rigidity and the amount of humectant added to the pad would be the same as for the heavier weight pad.

I claim:

1. A package with controlled relative humidity comprising:

a. an enclosed container with walls;

b. a humidistat pad inside the container adapted to receive humectant solution at the time of package filling, said pad comprising a laminate of:

i. a liquid impervious backing layer;

ii. an absorbent layer consisting of intermingled discrete fibers for retaining an aqueous humectant solution in its liquid phase; and iii. a liquid permeable cover of a spunbonded web of polymer filaments treated with a surfactant to facilitate rapid transfer of a humectant solution deposited on it to the absorbent layer and which can provide sites for volatilization of the humectant solution from its liquid phase to its vapor phase, wherein the humidistat pad is disposed in the container so that the impervious backing layer is between the container wall and the absorbent layer and wherein the humidistat pad remains rigid and resilient when wet with humectant solution.

2. The package of claim 1, wherein the humidistat pad is embossed with a pattern to enhance rigidity of the pad.

3. The package of claim 2, wherein the absorbent layer consists of a coform sheet of wood pulp fibers and polymer fibers.

4. The package of claim 3, wherein the coform sheet has a basis weight between 300–400 g/m$^2$.

5. The package of claim 3, wherein the coform sheet has a resiliency when wet with the humectant solution of 75%.

6. The package of claim 3, wherein the coform sheet has a rigidity when wet with the humectant solution of at least 9 cm.

7. The package of claim 3, wherein the humectant solution is selected from the group consisting of a saturated aqueous solution of potassium carbonate, magnesium acetate, and sodium acetate.

8. The package of claim 1, wherein the humidistat pad is disposed in the container in a folded manner approximating a "C" shape.

9. The package of claim 8, wherein the humidistat pad is kept in a folded configuration by adhering the contacting faces together.

10. The package of claim 9, wherein the coform sheet has a basis weight between 150–250 g/m$^2$.

* * * * *